US008484905B2

(12) United States Patent
Skjaerbaek et al.

(10) Patent No.: US 8,484,905 B2
(45) Date of Patent: Jul. 16, 2013

(54) TOWER AND METHOD FOR THE ASSEMBLY OF A TOWER

(75) Inventors: Poul Skjaerbaek, Videbaek (DK); Henrik Stiesdal, Odense C (DK)

(73) Assignee: Siemens Aktiengesellschaft, München (DE)

( * ) Notice: Subject to any disclaimer, the term of this patent is extended or adjusted under 35 U.S.C. 154(b) by 175 days.

(21) Appl. No.: 13/054,256

(22) PCT Filed: Aug. 18, 2008

(86) PCT No.: PCT/EP2008/060807

§ 371 (c)(1), (2), (4) Date: Jan. 14, 2011

(87) PCT Pub. No.: WO2010/006659

PCT Pub. Date: Jan. 21, 2010

(65) Prior Publication Data

US 2011/0113708 A1 May 19, 2011

Related U.S. Application Data

(60) Provisional application No. 61/080,812, filed on Jul. 15, 2008.

(51) Int. Cl.
*E04H 12/00* (2006.01)

(52) U.S. Cl.
USPC ..... 52/40; 52/651.07

(58) Field of Classification Search
USPC ..... 52/40, 30, 153, 245, 246, 301, 169.13, 52/848, 651.07
See application file for complete search history.

(56) References Cited

U.S. PATENT DOCUMENTS

| | | | |
|---|---|---|---|
| 7,106,085 | B2 | 9/2006 | Endo et al. |
| 7,114,295 | B2 | 10/2006 | Wobben |
| 2008/0040983 | A1 | 2/2008 | Fernandez Gomez et al. |

FOREIGN PATENT DOCUMENTS

| | | | |
|---|---|---|---|
| DE | 10126912 | A1 | 12/2002 |
| EP | 1262614 | A2 | 12/2002 |
| JP | 50021331 | A | 6/1975 |
| JP | 06076426 | | 3/1994 |
| JP | 9302615 | A | 11/1997 |
| JP | 2003027416 | A | 1/2003 |
| JP | 2005180082 | A | 7/2005 |
| JP | 2007077795 | A | 3/2007 |
| WO | WO 2007025947 | | 3/2007 |
| WO | WO 2008000265 | A1 | 1/2008 |
| WO | WO 2008031912 | | 3/2008 |

*Primary Examiner* — Basil Katcheves

(57) ABSTRACT

A number of pre-casted elements are stacked vertically to build the tower, while parts of the elements are forming the tower wall. Each element of the tower is fixed on its position and is connected with a tower foundation by a number of assigned post-tensioned cables. These cables are running inside the tower and they are pulled through the tower without embedding in dedicated channels. The post-tensioned-cables are fixed at certain points with the tower wall via damper-means to prevent their oscillation.

18 Claims, 7 Drawing Sheets

TOWER AND METHOD FOR THE ASSEMBLY OF A TOWER

CROSS REFERENCE TO RELATED APPLICATIONS

This application is the US National Stage of International Application No. PCT/EP2008/060807, filed Aug. 18, 2008 and claims the benefit thereof. The International Application claims the benefits of U.S. provisional application No. 61/080,812 filed Jul. 15, 2008. All of the applications are incorporated by reference herein in their entirety.

FIELD OF INVENTION

The invention relates to a method for the assembly of a tower and to the tower. In a preferred embodiment the tower is used for a wind-turbine.

BACKGROUND OF INVENTION

Wind-turbines are conventionally mounted on top of steel-towers. The towers consist usually of a number of modules.

As the price of steel is increasing more than the price of concrete it is advantageous to build wind-turbine-towers of concrete.

For large experimental wind-turbines it is known to build and use concrete towers, which are built by using a so called "slip-form pouring method". One example of this kind of tower was built 1977 for the Tvind-turbine in Denmark.

This method has the disadvantage that the concrete has to be filled into a mould, which is located at the top of the tower. At the end of the construction procedure the concrete has to be filled into the mould at the final height of the tower. In dependency of this height the efforts for the fill-in increases. Furthermore personnel are required to fill-in in the concrete into the mould at this final-height, so their work is limited by the time of the day, by health-regulations and by safety-requirements due to the height.

The WO 07025947 A1 discloses a method whereby a concrete tower is extruded vertically. This method has the disadvantage that it requires a very substantial technical arrangement, since high pressure is required for large-dimension components in order to push up the tower during casting. Large pressures at large diameters require very large technical arrangements.

It is also known to build concrete towers by the use of pre-casted segments. Such segments show dimensions which might anticipate the transport of the segments via roads or bridges. So additional effort need to be done to solve the problems of transportation.

It is known to build concrete towers by stacking of complete cylindrical elements. These elements are connected together by a number of post-tension cables. After the stacking of the elements a number of post-tension cables are inserted into channels in the tower walls. The channels transit the tower from the top to its bottom, while each post-tension cable is without discontinuation so the cable might reach a great effective length in dependency to the tower height. After cable insertion the channels are filled with a slurry material.

This arrangement has the disadvantage that for a high tower a reliable injection of the slurry needs special precautions.

Furthermore it may be difficult to insert the cables in the channels, particularly for a high tower.

The U.S. Pat. No. 7,114,295 discloses an improved method to solve these problems. A funnel-shaped apparatus is used for guiding the tension-cables and for establishing a seal to produce a pressure-tight transition between two tower segments. However despite these arrangements the problem remains to insert the post-tension-cables and to inject slurry into the channel for greater tower heights.

The U.S. Pat. No. 7,106,085 discloses a tower consisting of segments where no post-tension-cables are needed. This arrangement has the disadvantage that numerous mounting operations are required and that a high number of fasteners are needed.

The US 2008 004 0983 A1 discloses a tower consisting of segments. The segments do not require tensioning-cables, because they are pre-assembled on ground. This arrangement has the disadvantage that numerous mounting operations are required and that a high number of fasteners are needed.

The WO 08031912 A1 discloses a wind-turbine-tower, which is mounted with pre-fabricated elements. The tower has longitudinal ribs, which form longitudinal joints. These joints comprise metal elements and high resistance mortar. This leads to the disadvantage that numerous mounting operations are required and that a high number of fasteners are needed. Additionally high-strength mortar is needed.

SUMMARY OF INVENTION

It is the aim of the invention to provide an improved method for the assembly of a tower for a wind-turbine, and to provide an improved tower.

This aim is solved by the features of the independent claims.

Preferred embodiments are object of the dependant claims.

According to the invention a number of pre-casted elements are stacked vertically to build the tower. Parts of the elements are forming the tower wall. Each element of the tower is fixed on its position and is connected with a tower foundation by a number of assigned post-tensioned cables, which are running inside the tower.

The post-tensioned-cables of the elements are pulled through the tower without embedding in dedicated channels in the tower walls. The post-tensioned-cables are fixed at certain points with the tower wall via damper-means to prevent or to minimize their oscillation.

The invention combines

- a stacking of pre-casted elements,
- the elements being fixed with post-tensioned cables that do not require to be inserted into special channels, and
- the post-tensioned cables being damped at certain points to minimize their vibrations.

According to the invention a concrete tower is constructed by the stacking of cylindrical or tapered concrete pipes on top of each other. The pipes are joined to form a structural entity with post-tension cables which do not run inside cavities in the tower walls. The cables are hindered from oscillation through the application of suitable damper-means.

In a preferred embodiment the concrete tower is built by a number of cylindrical or tapered pre-cast elements as modules, each forming a complete annular element.

Some or all of these elements are fitted with structural elements that support dampers for attachment to the post-tensioning cables.

The tower is constructed by a stacking of the pre-cast modules on top of each other, until the complete tower is formed. After this stacking the post-tensioning cables are fitted and tensioned. During or after the cable installation suitable damper means are attached to the cables in order to prevent oscillation.

In a preferred embodiment one or more of the pre-casted elements or modules are casted on a planned site. A bottom module is cast directly on the foundation. Supplementary modules are cast adjacent to the turbine-location or in another suitable location on or near a wind-farm site. Other modules are supplied as precast or prefabricated elements, maybe from elsewhere. Such other modules may be made of concrete or steel.

Modules which are cast on a site can preferably be made with a module height that does not exceed the height at which an ordinary portable concrete pump for common contracting purposes can reach.

A module or element can be cast in a form or mould consisting of a bottom part, an inner part, an outer part and a top part. The top part and/or the bottom part are integrated in a preferred embodiment into either the outer part or into the inner part. For example the bottom part may be integrated with the inner part and the top part may be integrated with the outer part.

Due to the effect of installed post-tensioning cables longitudinal reinforcement of individual modules may not be needed to carry tensile stresses. The longitudinal reinforcement may be limited to the amount needed for handling purposes. Circumferential and shear reinforcement may be limited to the amount needed to ensure integrity under load and to transfer shear forces and torque.

In a preferred embodiment fibre-reinforced concrete is used, classical reinforcement with rebars is avoided. Fibers could be steel- or glass-fibers.

When the stacking of the modules is completed a number of cables are pulled partly and/or completely through the completed tower. The cables are fixed at a first end, thereafter they are fixed at the other end and tensioned.

The tensioning-cables are fitted with suitable damper means. The damper means may be tuned absorbers or dampers achieving their effect by viscous means.

In a preferred embodiment the damping is obtained by connecting the cables at regular intervals to a tower wall with a bracket or similar structures. The joint between cable and bracket and/or bracket and tower is fitted with a viscous damping element, e.g. a rubber or a tar compound In a preferred embodiment the lowest tower module is cast directly onto a foundation-base-plate, so the preparation of a tower plinth is avoided.

In another preferred embodiment the lowest tower module is cast directly on rocky ground and the foundation is limited to simple rock-anchors.

BRIEF DESCRIPTION OF THE DRAWINGS

The invention is shown in more detail by help of the following figures, where.

DETAILED DESCRIPTION OF INVENTION

Figure 1:
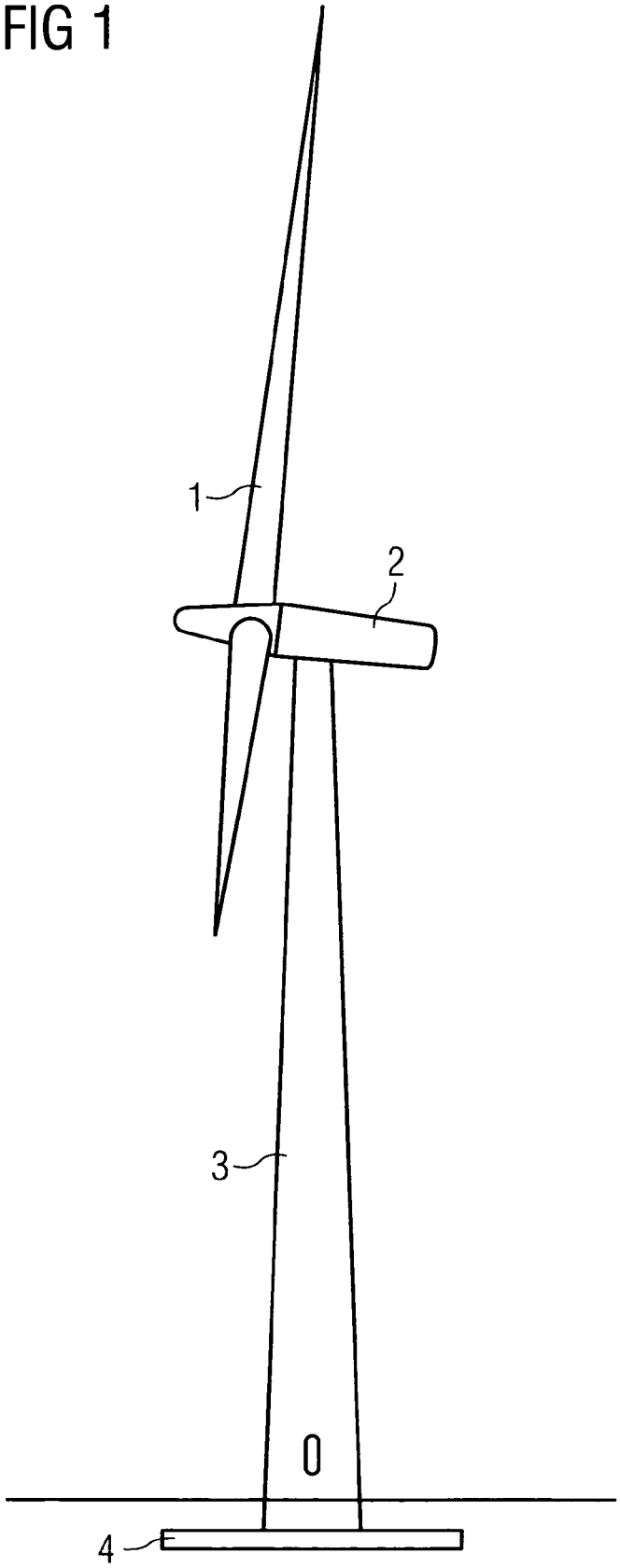
FIG. 1 shows a wind-turbine using the tower according to the invention.

FIG. 1 shows a wind-turbine using the tower according to the invention. The wind-turbine comprises a rotor 1, which is supported by a nacelle 2. The nacelle 2 is mounted on a tower 3, which is supported by a foundation 4.

Figure 2:
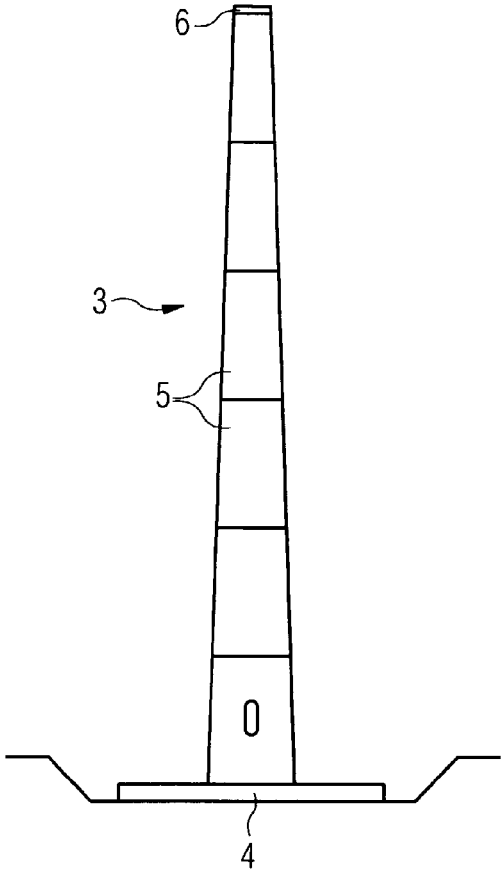
FIG. 2 shows the concrete tower according to the invention, referring to FIG. 1.

FIG. 2 shows the concrete tower 3 according to the invention, referring to FIG. 1.

The concrete tower 3 is constructed with elements as modules 5, which are stacked on top of each other. In a preferred embodiment a last module 6, which is located on top of the tower 3, is substantially shorter than its preceding module 5.

Figure 3:
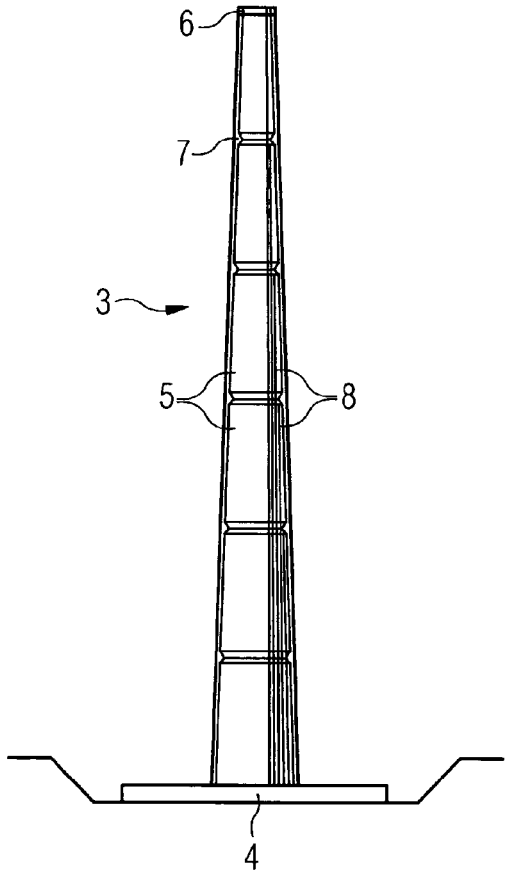
FIG. 3 shows the tower according to the invention in more detail, referring to FIG. 2.

FIG. 3 shows the tower according to the invention in more detail, referring to FIG. 2.

In this embodiment each tower module 5 (except the tower module 6 on the top) shows a cable-supporting protrusion 7 at its top.

On the right side of the tower 3 centerlines of post-tensioning cables 8 are shown. Some of them run through the entire length of the tower 3, from the top module 6 down to the foundation 4, crossing all the modules 5.

Other post-tensioning cables 8 transit only through a number of modules 5, so they run from the top of a dedicated module 5 through all the modules 5, which are located below the dedicated module 5.

In this figure the post-tensioning cables 8 are shown descending vertically.

Figure 4:
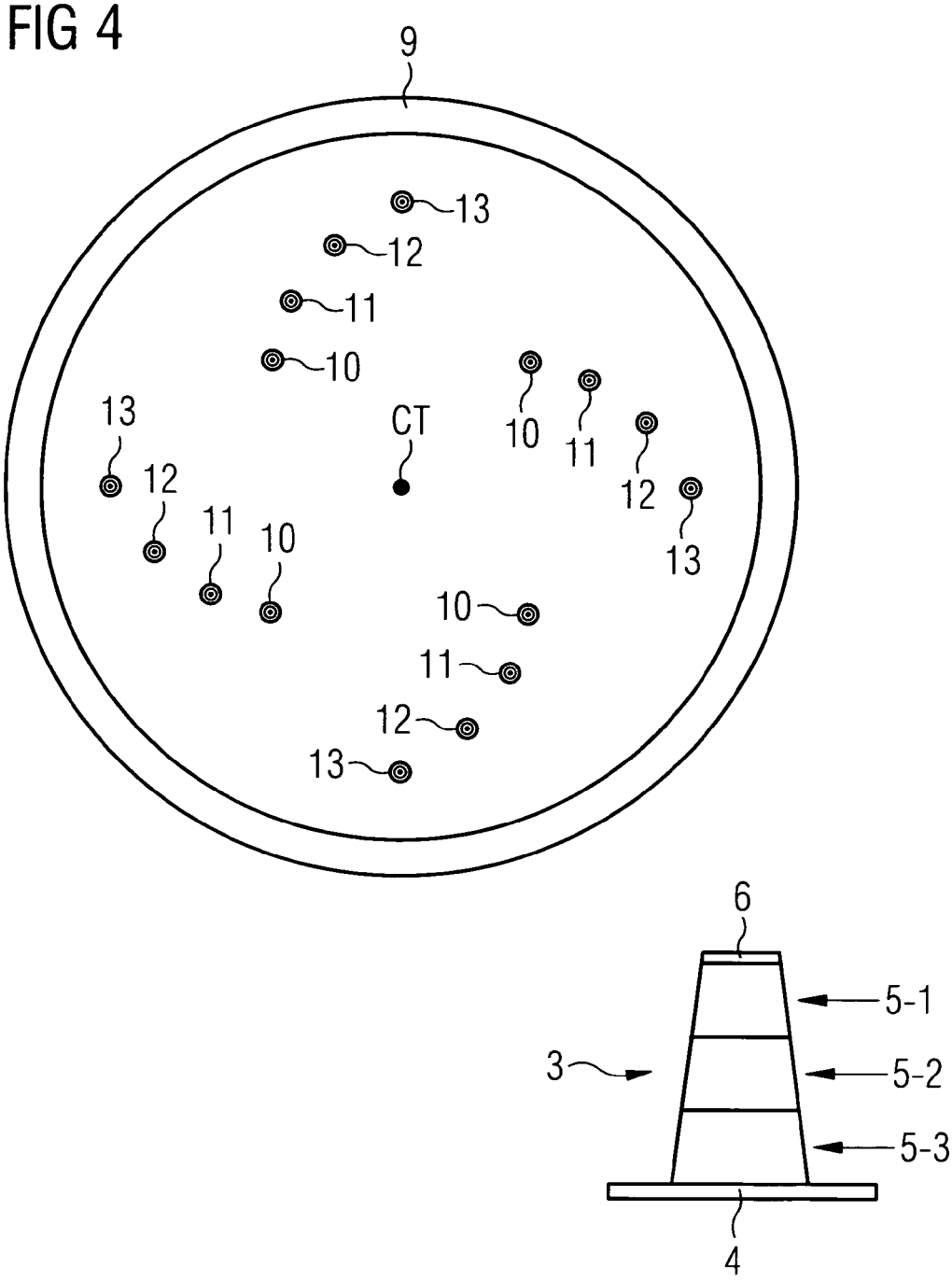
FIG. 4 shows a transversal section through the tower 3, referring to FIG. 3.

FIG. 4 shows a transversal section through the tower 3, referring to FIG. 3.

In this example each of the tower modules 5 and 6 has four post-tensioning cables, which connects the modules 5 and 6 to the foundation 4.

The cables from the tower modules 5, 6 are located in an offset-circumferentially manner, so they do not interfere with each other.

A tower wall 9 encloses the cables.

As the cables are descending vertically in this example, four cables 10 from the top module 6 are closest to a centre CT of the tower.

Four cables 11 are assigned to a module 5-1, while four cables 12 are assigned to a module 5-2 and four cables 13 are assigned to a module 5-3, counted down from the top of the mast 3 to the foundation 4.

The cables 11, 12 and 13 are located progressively closer to the tower wall 9.

Figure 5:
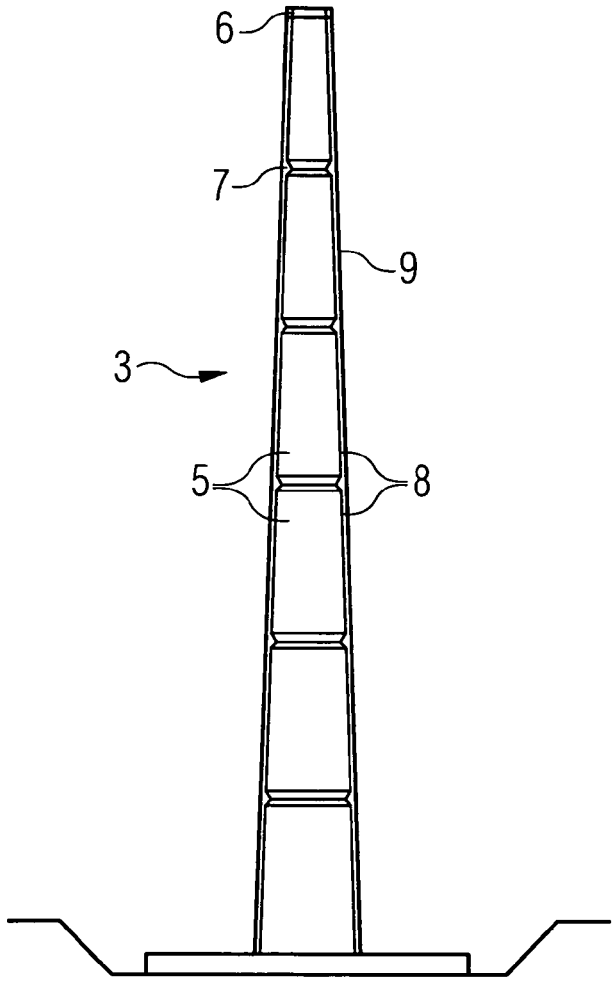
FIG. 5 shows a longitudinal section through the concrete tower according to the invention.

FIG. 5 shows a longitudinal section through the concrete tower 3 according to the invention.

Differing to FIG. 3 the post-tensioning cables 8 descend parallel to the tower wall 9.

Figure 6:
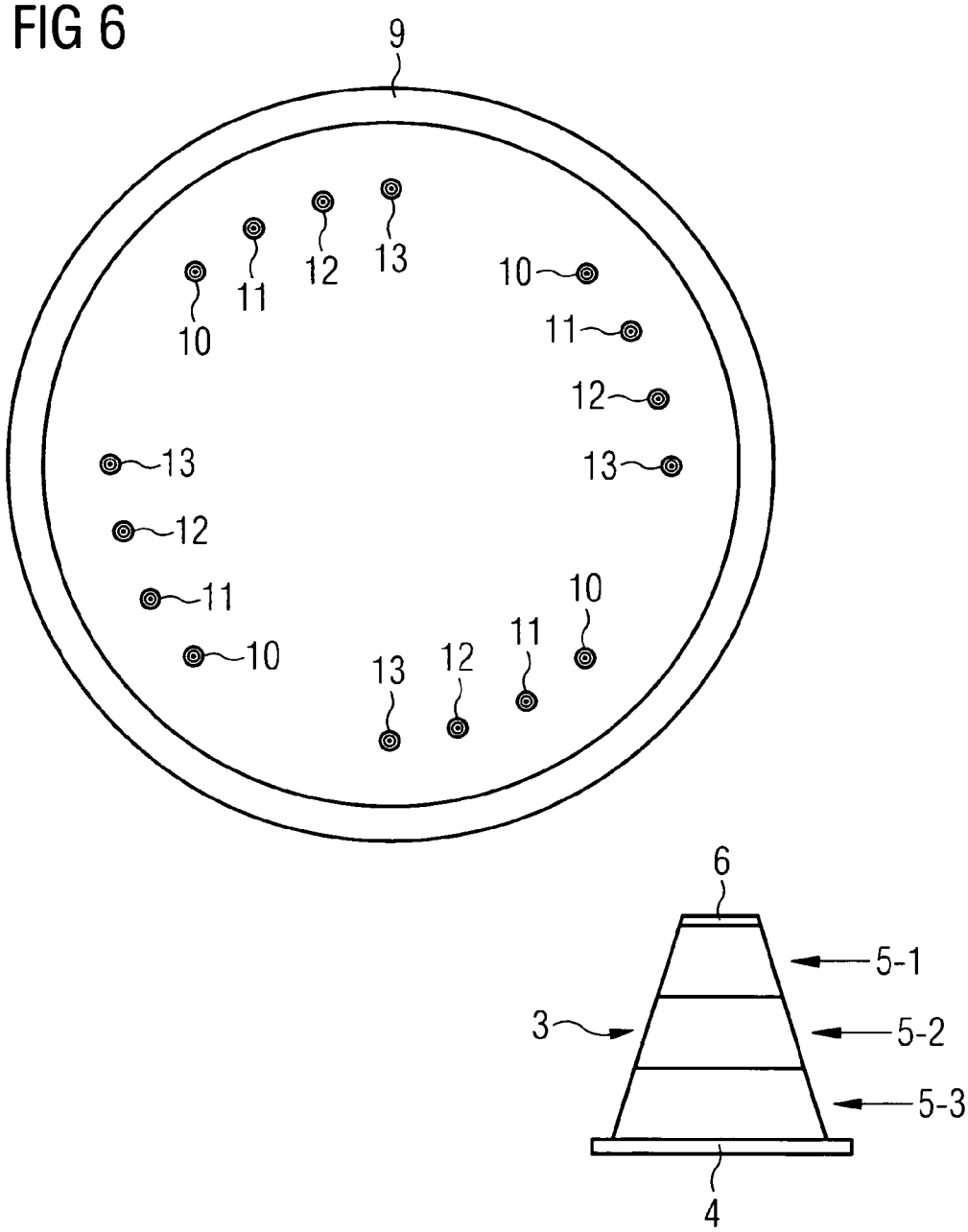
FIG. 6 shows a transversal section through the tower 3, referring to FIG. 5.

FIG. 6 shows a transversal section through the tower 3, referring to FIG. 5.

In this example each of the tower modules 5 and 6 show four post-tensioned cables, which connect the modules 5 and 6 to the foundation 4.

The cables from the tower modules are located in an offset-circumferentially-manner, so they do not interfere with each other.

A tower wall 9 encloses the cables. Because the cables descend in parallel to the tower wall 9, the four cables 10 from the top module 6, the four cables 11 from a module 5-1, the four cables 12 from a module 5-2 and the four cables from a module 5-3 show an equally spacing from the tower wall 9.

Figure 7:
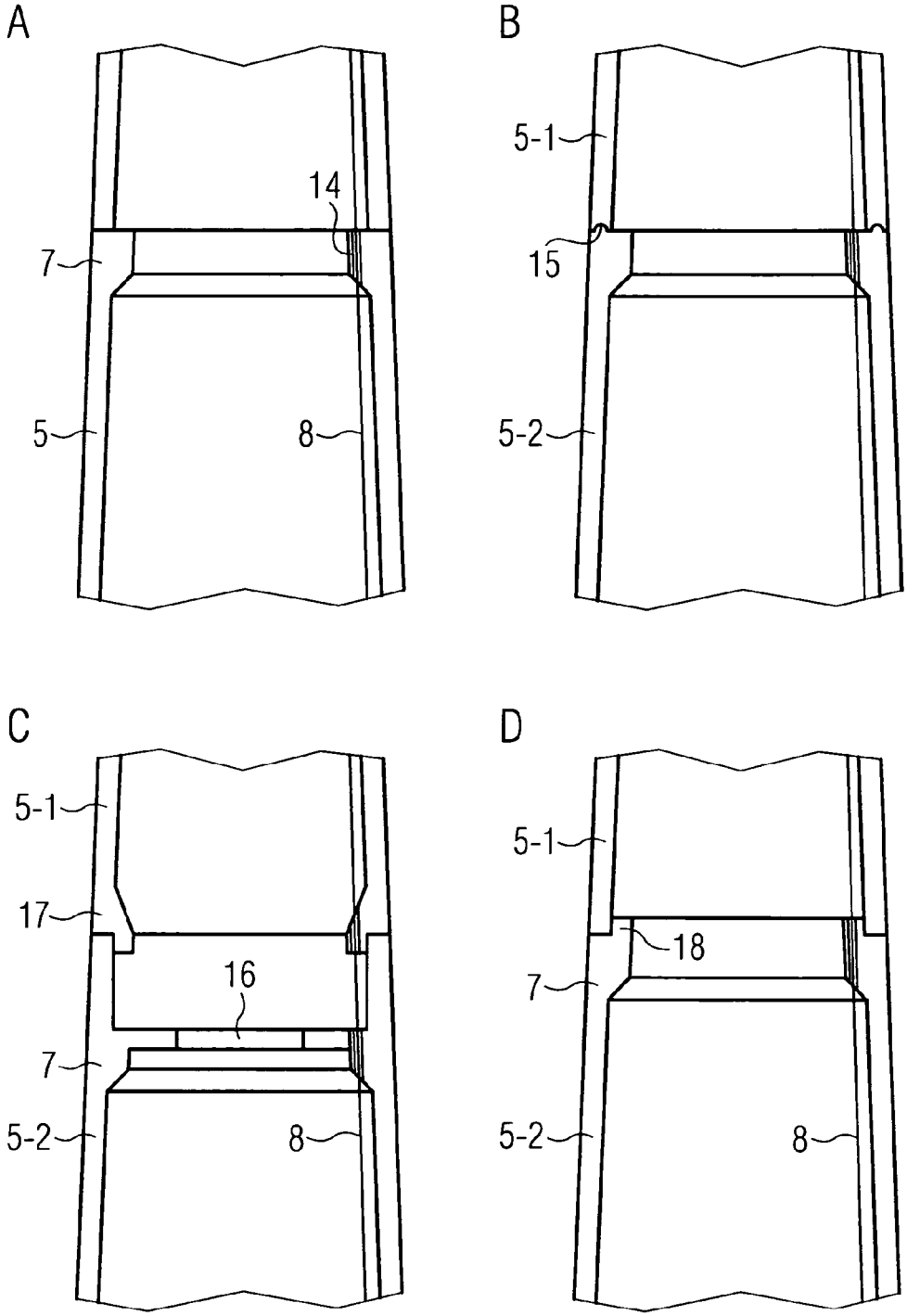
FIG. 7 shows four variants of a joint to connect tower modules.

FIG. 7 shows four variants of a joint to connect the tower modules.

Referring to FIG. 7A the tower module 5-1 has a cable-supporting protrusion 7 that either serves as anchor point for a post-tensioning cable 8 or that serves as support for the damping of a cable from a higher module—e.g. by a channel 14 that may be filled with a tar-based or a rubber-based compound once the cable 8 is already inserted.

Referring to FIG. 7B adjacent modules 5-1 and 5-2 are centered using a finger- and groove-arrangement 15.

Referring to FIG. 7C adjacent modules 5-1 and 5-2 are centered using an overlap.

Here the cable-supporting protrusion 7 is extended inwards to serve as a platform, only leaving a hole 16 for power cables, for a ladder or a lift.

An upper module 5-1 has a recess 17 that centers the upper module 5-1 when it is mounted onto the lower module 5-2.

Referring to FIG. 7D adjacent modules 5-1 and 5-2 are centered using an overlap.

Here the cable-supporting protrusion 7 is extended upwards to provide a centering recess 18 for an upper module 5-1. The upper module 5-1 centers on this recess 18 when it is placed onto a lower module 5-2.

Figure 8:
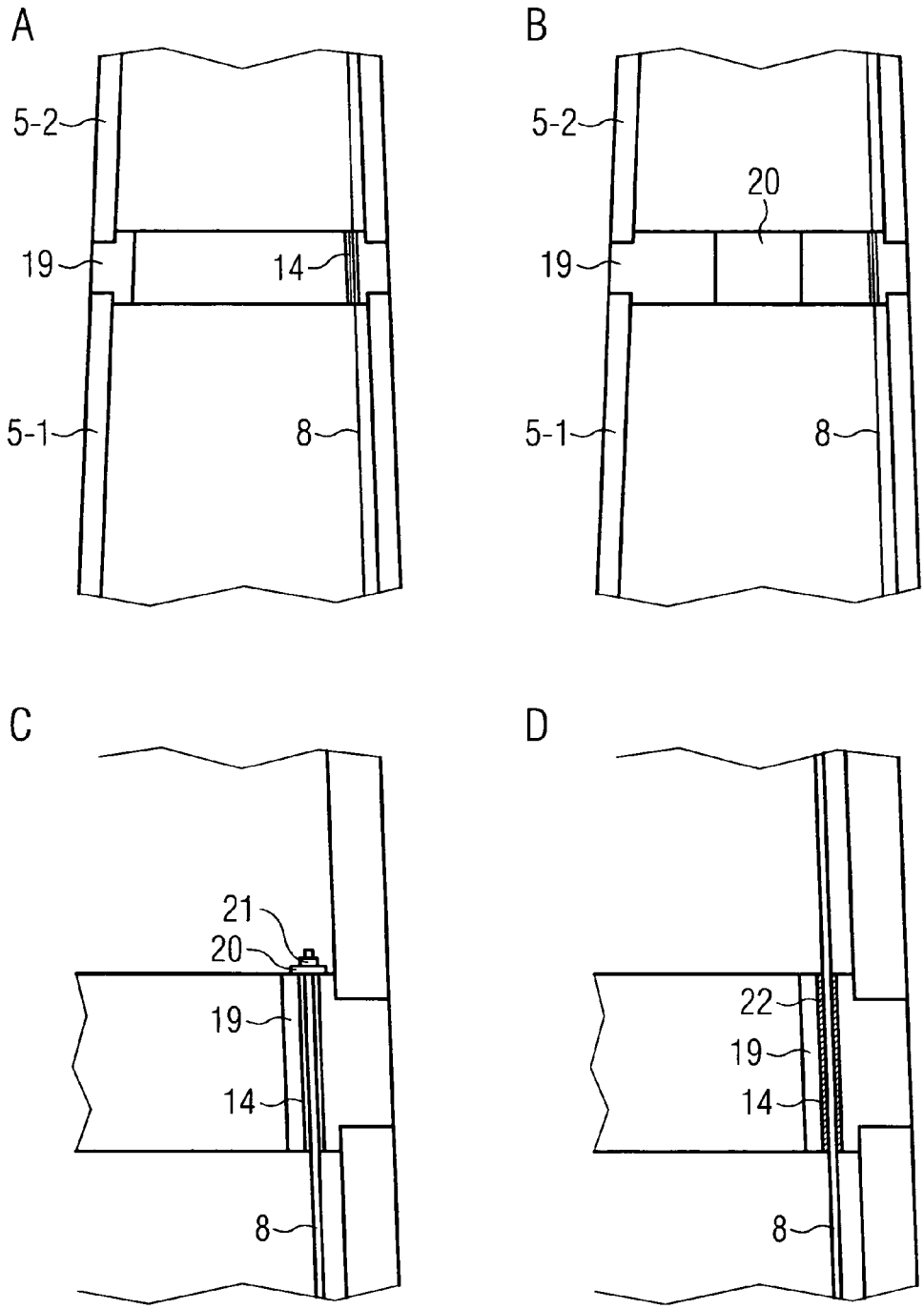
FIG. 8 shows further variants of the joint between adjacent tower modules and of cable arrangements.

FIG. 8 shows further variants of the joint between adjacent tower modules and of cable arrangements.

Referring to FIG. 8A the tower module 5-1 and 5-2 does not have a cable supporting protrusion as described above.

Instead of this a centering piece 19 is placed between two adjacent modules 5-1 and 5-2. The centering piece 19 has holes 14, which are used for the cables 8.

Referring to FIG. 8B the centering piece 19 has only a small hole 20 for power cables, for a lift or ladder and thereby it is used as a platform.

Referring to FIG. 8C an attachment of the post-tensioning cables 8 at a centering piece 19 is shown.

The cable 8 projects through a hole 14 in the centering piece 19. On top of a load distributing washer 20 or ring 20 the cable 8 is tensioned using a nut 21.

Referring to FIG. 8D a damping of a post-tensioning cable 8 attached at a higher level is shown.

The cable 8 passes through a hole 14 in the centering piece 19.

Once the cable 8 is tensioned, a suitable damping compound 22 is applied to be filled into the hole 14.

The invention claimed is:

1. A method for the assembly of a tower, comprising:

vertically stacking a plurality of pre-casted elements to form a wall of a tower;

connecting each of the plurality of pre-casted elements with a tower foundation by a plurality of assigned post-tensioned-cables, which are located inside the tower;

pulling the post-tensioned-cables through the tower without embedding in dedicated channels in the tower walls; and fixing each of the post-tensioned-cables at points with the tower wall via a damper element to prevent oscillation, wherein the post-tensioned-cables are stacked upon one of the plurality of pre-casted elements and are guided in an offset-circumferentially manner through the one pre-casted element in order to avoid interferences.

2. The method according to claim 1, wherein each of the plurality of pre-casted elements are cylindrically shaped or tapered.

3. The method according to claim 1, wherein post-tensioned-cables of a pre-casted element are fixed with a first ending at the pre-casted element, pulled inside subsequent pre-casted elements to the tower foundation and fixed at the tower foundation with a second ending.

4. The method according to claim 1, wherein a bottom element of the tower is cast directly on the tower foundation.

5. The method according to claim 4, wherein the plurality of pre-casted elements are casted on site of the tower.

6. The method according to claim 4, wherein the plurality of pre-casted elements are casted off site of the tower.

7. The method according to claim 1, wherein a bottom element of the tower is cast directly on rocky ground, and wherein rock-anchors are used for securing of the post-tensioned-cables.

8. The method according to claim 1, wherein at least one of the plurality of pre-casted elements is made of concrete or steel.

9. The method according to claim 8, wherein, when the at least one of the plurality of pre-casted elements is made of concrete, the at least one of the plurality of pre-casted elements is reinforced by fibers.

10. The method according to claim 9, wherein the fibers are steel or glass.

11. The method according to claim 1, wherein the points for the damper elements are spaced with a regular distance as interval.

12. The method according to claim 1, wherein a joint is used to fix each of the post-tensioned-cable with the point, while the joint is fitted with a viscous damping-element.

13. The method according to claim 12, wherein the viscous damping element is made of a rubber or a tar compound.

14. The method according to claim 1, wherein the damper elements are tuned absorbers.

15. The method according to claim 1, further comprising:

arranging a last element on top of the tower, wherein the last element is adjacent to one of the plurality of pre-casted elements, and wherein a vertical height of the top element is substantially shorter than a vertical height of the adjacent element.

16. The method according to claim 1, wherein the post-tensioned-cables are pulled through the plurality of pre-casted elements close or parallel to the tower wall.

17. The method according to claim 1, wherein the tower is used for a wind-turbine.

18. A tower for a wind-turbine, comprising a tower foundation;

a plurality of post-tensioned cables;

a plurality of pre-casted elements constructed to be stacked vertically to build the tower, wherein the plurality of pre-casted elements form a wall of the tower, wherein each of the plurality of pre-casted elements is assigned a portion of the plurality of post-tension cables which are attached to the respective pre-casted element, the plurality of post-tension cables extending vertically inside the tower through dedicated channels in the tower wall such that the post-tension cables are not embedded in the dedicated channels; and a damper element, each of the plurality of post-tensioned-cables are fixed at points with the tower wall via the damper element to prevent oscillation of the respective cable, wherein the post-tensioned-cables are stacked upon one of the plurality of pre-casted elements and are guided in an offset-circumferentially manner through the one pre-casted element in order to avoid interferences.

* * * * *